US011130250B2

(12) United States Patent
Smith

(10) Patent No.: US 11,130,250 B2
(45) Date of Patent: Sep. 28, 2021

(54) BUTTERFLYING HOT DOG SLICER

(71) Applicant: W. Reed Smith, Metairie, LA (US)

(72) Inventor: W. Reed Smith, Metairie, LA (US)

( * ) Notice: Subject to any disclaimer, the term of this patent is extended or adjusted under 35 U.S.C. 154(b) by 0 days.

(21) Appl. No.: 16/736,118

(22) Filed: Jan. 7, 2020

(65) Prior Publication Data

US 2021/0206013 A1 Jul. 8, 2021

(51) Int. Cl.
*B26D 3/24* (2006.01)

(52) U.S. Cl.
CPC ..... *B26D 3/24* (2013.01); *B26D 2210/02* (2013.01)

(58) Field of Classification Search
CPC .... B26B 3/04; B26B 3/00; B26D 3/24; B26D 3/08; Y10T 83/8821; Y10T 83/8831; Y10T 83/04; Y10T 83/8834
USPC ..... 83/662, 822, 613, 620, 648, 870, 885, 83/451, 761, 762, 932; 30/289, 278, 30/296.1, 90.4, 90.6, 124, 302, 303, 299, 30/141, 128, 114, 279.2, 287, 362; 99/430, 441, 509, 537, 439; 426/92, 104, 426/105, 144, 646, 641, 76; 452/30, 141; D7/673
See application file for complete search history.

(56) References Cited

U.S. PATENT DOCUMENTS 2,520,000 A 8/1950 Dettman
2,675,580 A 4/1954 Pesce
D214,772 S * 7/1969 Carlson ..... D7/673
D284,441 S 7/1986 Way
4,976,029 A * 12/1990 Kennedy ..... A47J 43/28 30/114
5,069,914 A * 12/1991 Gagliardi, Jr. ..... A23L 13/65 426/76
6,187,361 B1 * 2/2001 Fleetham ..... A23L 13/60 426/104
7,065,880 B2 6/2006 Howman et al.
7,258,053 B2 8/2007 Suer et al.
7,340,835 B2 3/2008 Howman et al.
7,592,029 B1 * 9/2009 Linck ..... A01J 27/04 426/518
D670,140 S 11/2012 Kavanaugh et al.
D706,092 S 6/2014 Pavlak
2002/0090427 A1 * 7/2002 Jordan ..... B26D 3/08 426/144
2004/0093738 A1 * 5/2004 Mauro ..... B26D 5/10 30/113.1
2006/0042434 A1 * 3/2006 Cumpton ..... B26D 3/08 83/13
2008/0201956 A1 8/2008 Bouton et al.

* cited by examiner

*Primary Examiner* — Ghassem Alie

(74) *Attorney, Agent, or Firm* — Adam V. Vickers; Intellectual Property Consulting. LLC

(57) ABSTRACT

In at least one embodiment, a hot dog slicer is provided that includes a tubular body having a lumen defined by an inner surface of the tubular body between front and rear openings therein, and at least a first blade extending inward from the inner surface of the tubular body sufficiently for a hot dog to be butterflied by passing the hot dog through the lumen of the tubular body.

6 Claims, 4 Drawing Sheets

BUTTERFLYING HOT DOG SLICER

BACKGROUND OF THE INVENTION

The present application relates to food slicers and more particularly slicers for cutting hot dog and/or sausages.

The hot dog is a type of sausage or wiener sandwich which was culturally imported from Germany and which became popular in the United States first as a street food, sold at stands and carts, and later at sporting events. Today, the hot dog has also become a main stay food bought in grocery stores and served daily in millions of homes across America.

Hot dogs are prepared and served in a multitude of ways, such as by itself, on a stick or on a bun.

A hot dog is configured in the form of a cylinder. Because of its geometry this food is subject to roll off a plate. To make the hot dog cylinder shape easier to handle, the hot dog bun was invented.

To further improve handling or to create a novel eating experience, throughout its history, the hot dog has been cut in sections, sliced diagonally and sliced length wise by various devices created specifically for hot dog cutting purposes.

Until now such devices for slicing hot dogs segment a hot dog into pieces of various sizes and shapes in an attempt to improve handling. Often times these devices have sharp blades, which are hazardous to the unwary operator. Typically, these devices do not reconfigure the hot dogs cylinder shape into an expandable flat food and thus eliminate rolling off the plate or a need for a special bun.

Butterfly cutting ("butterflying") a hot dog is another form of meat preparation. In meat preparation a butterfly cut is a lengthwise cut without separating the meet. The idea is to restructure to a thinner section for faster cooking and alleviating bursting or blistering. A second effect is that it allows a hot dog to cook more evenly. Particularly for those who prefer there hot dog well done butterflying can get the insides cooked through without charring the outside. The typical way for butterflying a hot dog is to use a knife, but this requires skill and may be hazardous to the unwary operator. Also, it is just about impossible to make the Z cut on a hot dog with a knife. If you use a knife, you are in all likelihood just going to slice the hot dog lengthwise into 2 folds or pieces, not 3. And the knife will probably slice all the way through the dog.

Thus, there remains a need for a hot dog slicer that is safe, easy to use, produces a butterfly cut and systematically slices a hot dog to be expandable, unfolded out into a flat position, for use on a plate, sliced bread, French bread, hoagie roll or a hamburger bun.

SUMMARY OF THE INVENTION

In at least one embodiment, a hot dog slicer is provided that includes a tubular body having a lumen defined by an inner surface of the tubular body between front and rear openings therein, and at least a first blade extending inward from the inner surface of the tubular body sufficiently for a hot dog to be butterfly by passing the hot dog through the lumen of the tubular body.

In at least one embodiment, the hot dog slicer includes a second blade extending inward from the inner surface of the tubular body opposite the first blade sufficient for the hot dog to be double butterflied by passing the hot dog through the lumen of the tubular body.

In at least one embodiment, each of the blades has a planer portion and wherein the planer portions are parallel to each other.

In at least one embodiment, the tubular body has a cylindrical shape.

In at least one embodiment, the lumen of the tubular structure is dimensioned to accept standard commercial hot dogs.

In at least one embodiment, the tubular body has a cylindrical shape having a diameter of about 1.25 to about 1.5 inches.

In at least one embodiment, the tubular body has a cylindrical shape having a front to rear length of about 1.25 to about 1.5 inches.

In at least one embodiment, the tubular body has a cylindrical shape having a lumen with a radius of about 0.5 to about 0.75 inches.

In at least one embodiment, the hot dog slicer includes a second blade extending inward from the inner surface of the tubular body opposite the first blade sufficient for the hot dog to be double butterflied by passing the hot dog through the lumen of the tubular body, wherein at least one of the first and second blades extends inward between about 0.75 inches and about 0.97 inches.

In at least one embodiment, the hot dog slicer includes a second blade extending inward from the inner surface of the tubular body opposite the first blade sufficient for the hot dog to be double butterflied by passing the hot dog through the lumen of the tubular body, wherein the first and second blades are equally spaced within the lumen of the body.

In at least one embodiment, the hot dog slicer includes a second blade extending inward from the inner surface of the tubular body opposite the first blade sufficient for the hot dog to be double butterflied by passing the hot dog through the lumen of the tubular body, wherein edges of the first and second blades are single bevel and are arranged within the lumen to be mirror images of each other about a central plane.

In another embodiment, a hot dog slicer is provided that includes a cylindrical tubular body having a lumen defined by an inner surface of the tubular body between front and rear openings therein, and at least a first and second blades extending inward from the inner surface of the tubular body a second blade extending inward from the inner surface of the tubular body from opposite sides of the lumen sufficiently for a hot dog to double butterfly the hot dog by passing the hot dog through the lumen of the tubular body.

In at least one embodiment, each of the blades has a planer portion and wherein the planer portions are parallel to each other.

In at least one embodiment, the lumen of the tubular structure is dimensioned to accept standard commercial hot dogs.

In at least one embodiment, the tubular body has a cylindrical shape having a diameter of about 1.25 to about 1.5 inches.

In at least one embodiment, the tubular body has a cylindrical shape having a front to rear length of about 1.25 to about 1.5 inches.

In at least one embodiment, the tubular body has a cylindrical shape having a lumen with a radius of about 0.5 to about 0.75 inches.

In at least one embodiment, at least one of the first and second blades extends inward between about 0.75 inches and about 0.97 inches.

In at least one embodiment, the first and second blades are equally spaced within the lumen of the body.

In at least one embodiment, the edges of the first and second blades are single bevel and are arranged within the lumen to be mirror images of each other about a central plane.

Additional aspects of the present invention will be apparent in view of the description which follows.

DETAILED DESCRIPTION OF THE INVENTION

Referring to FIG. 1 through FIG. 8 various aspects of the hot dog slicer 10 according to the present disclosure are described. It is to be understood, however, the examples are merely exemplary in describing the device and method of the present disclosure. Accordingly, any number of reasonable modifications, changes and substitutions are contemplated without departing from the spirit and scope of the present disclosure.

"Butterflying" is a way of preparing meet for cooking by cutting it almost in two, while leaving the parts connected. "Butterflying", the term butterfly, comes from the resemblance of the cut to the wings of the insect, the butterfly. "Butterflying" transforms a thick compact piece of meat involves cutting it into a thinner one that has a greater surface area. Typically the meat, in particular to this discloser a hot dog 24, is laid out on a cutting board and cut in half or in thirds parallel to the board almost all the way to the other side, leaving a small hinge which is used to fold the meat open like a book. This is a difficult process for even an experienced cook. Often times the process is avoided by the novice cook for fear of a potential cutting injury to the hands or fingers. Children, in particular, are discouraged from this activity.

"Butterflying" exposes a greater area of the surface to the cooking heat, leading to browning and a smoky flavor. It also decreases cooking time and allows for more even cooking.

Figure 8:
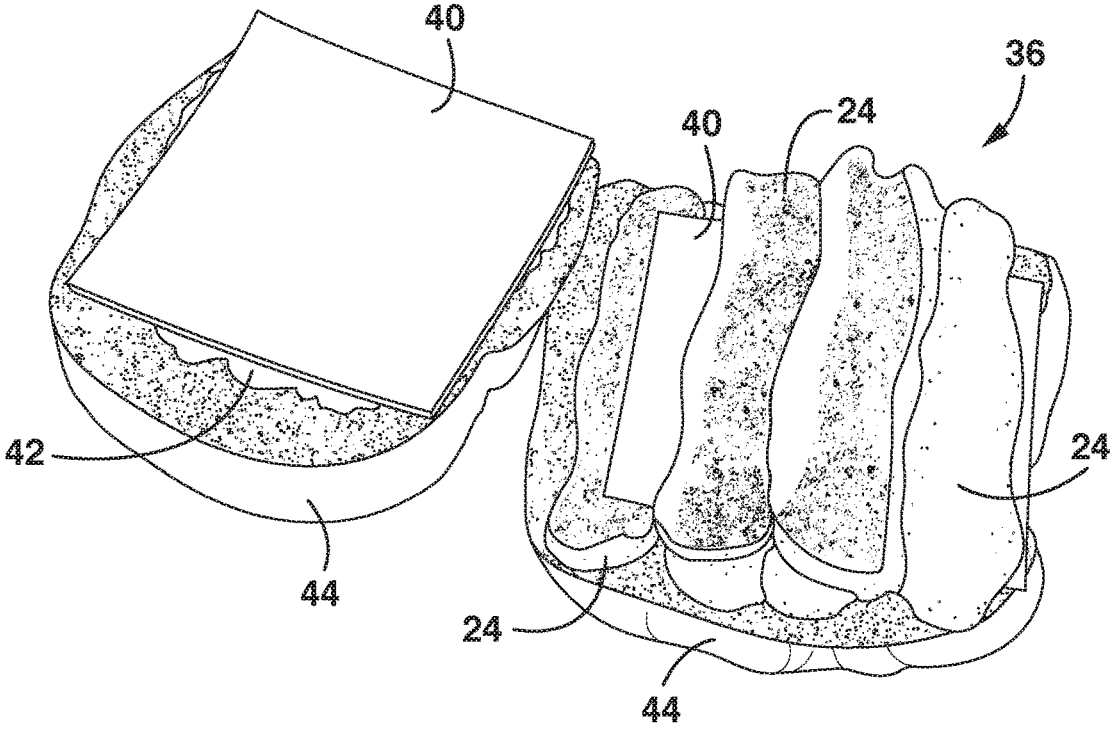
FIG. 8 is a perspective view of an open unfolded hot dog in a novelty sandwich.

The "butterflying" hot dog slicer 10 according to the embodiments discussed herein is a safe, easy to use device, producing a butterfly cut and systematically slicing a hot dog to be expandable, unfolded out into a flat position, an open unfolded hot dog 36, for cooking purposes or for use on a plate, sliced bread or a hamburger bun 44, as shown in FIG. 8.

Figure 1:
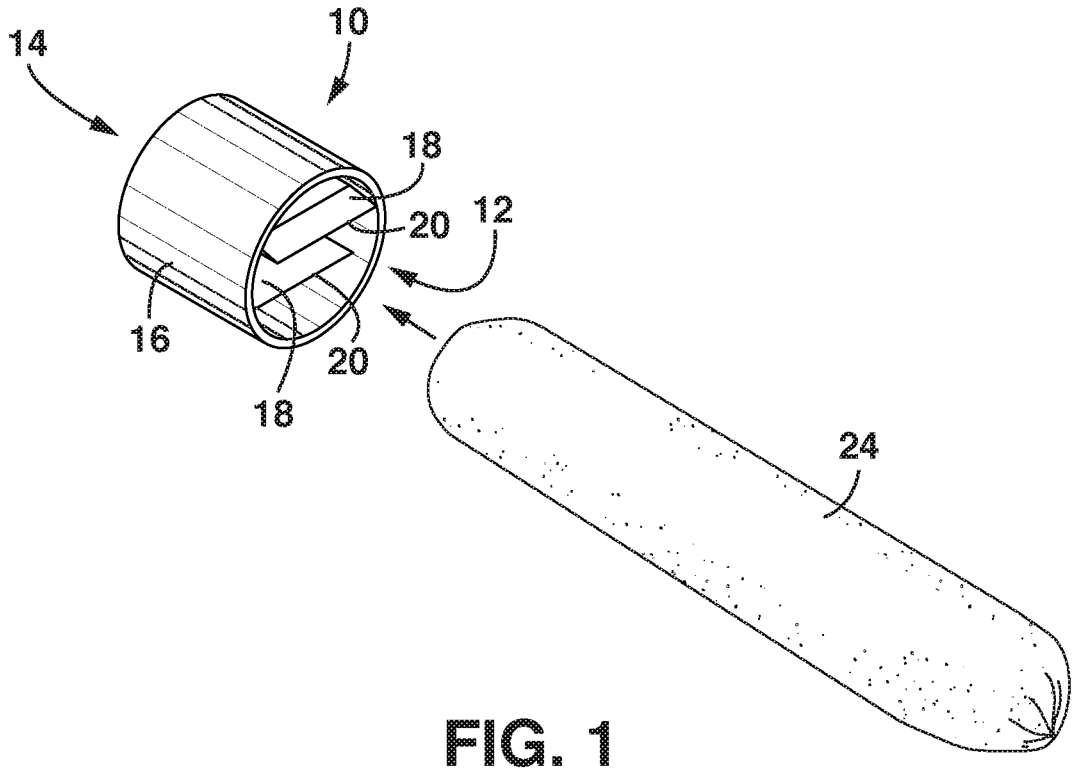
FIG. 1 is a perspective view of a hot dog slicer with a hot dog ready to be inserted into the hot dog slicer.
Figure 2:
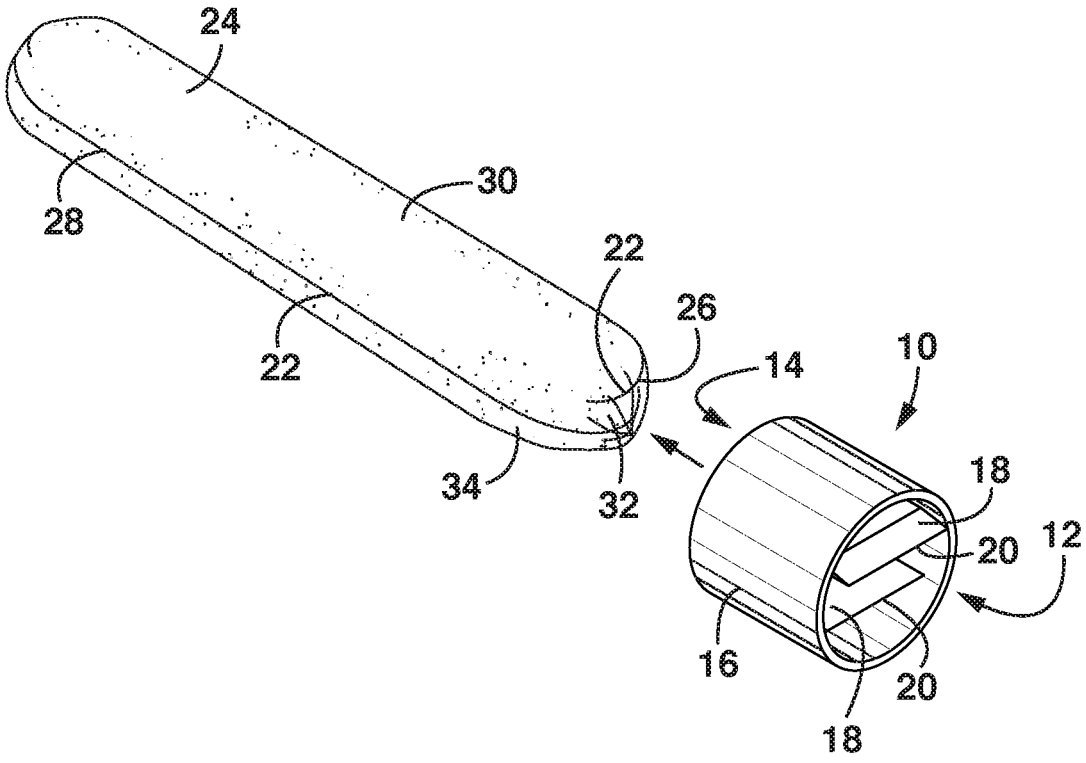
FIG. 2 is a perspective view of a hot dog slicer with a sliced hot dog after exiting the hot dog slicer.
Figure 3:
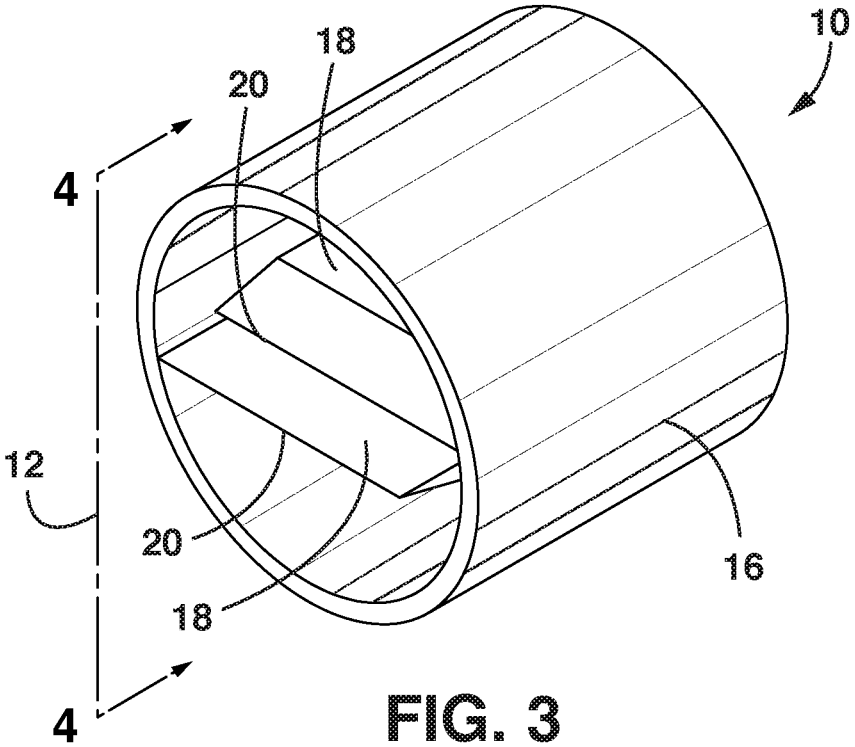
FIG. 3 is a perspective view of a hot dog slicer.
Figure 4:
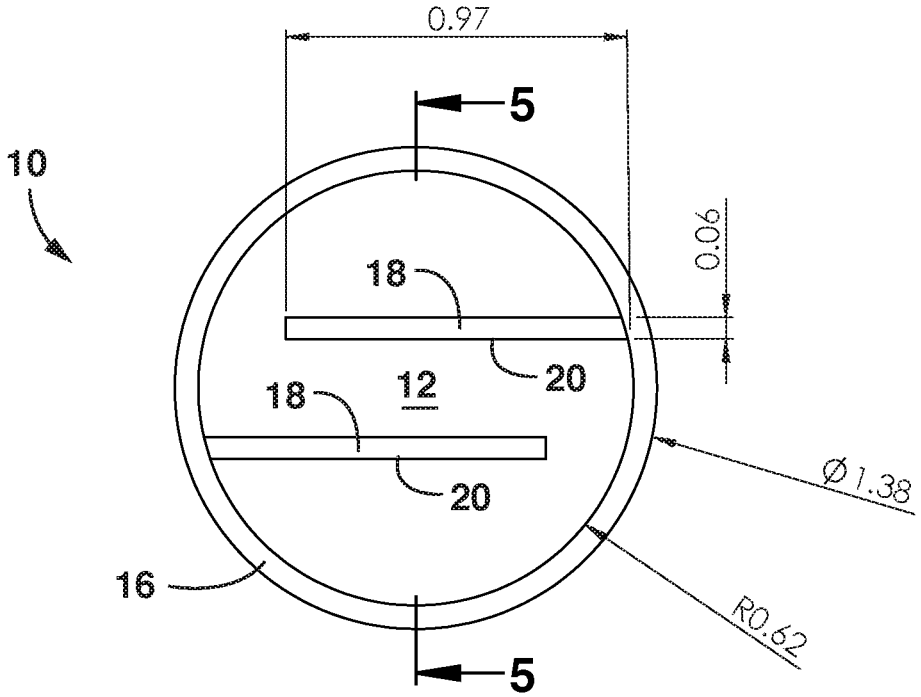
FIG. 4 is a front elevation view taken from FIG. 3.
Figure 5:
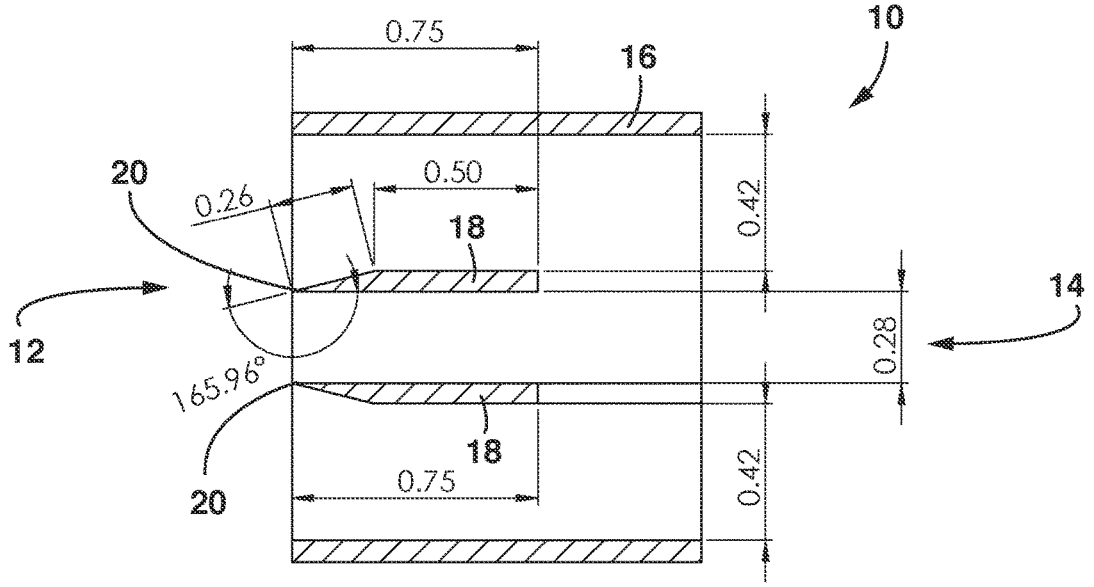
FIG. 5 is a center section view taken from FIG. 4.

FIG. 1 through FIG. 6 depict an embodiment of a "butterflying" hot dog slicer 10. A hot dog slicer 10 can be made of any material. Plastic is a preferred material in at least one embodiment. A hot dog slicer 10 generally has a body 16 having an open front 12 and an open back 14. A body 16 has an outer perimeter, configured in any shape about a hollow interior, therewith forming a tubular structure having a lumen sufficiently sized for the hot dog 24 to pass through the lumen. In one embodiment a body 16 has a cylindrical form. A cylindrical body 16 can measure about 1.38 inches in diameter by about 1.38 inches in length (front to back). A body's 16 interior space can have a radius of about 0.62 inches. A body 16 can contain one or more blades 18 having at least one slicing edge 20, preferably facing the front end 12 of the slicer 10. In one embodiment two blades 18 are present to allow for double butterflying the hot dog 24 in a single action. A blade may measure laterally between about 0.75 inches and about 0.97 inches across the length of the blade's 18 slicing edge 20. The thickness of a blade 18 is about 0.06 inches. In cross section, a slicing edge 20 is configured with a hypotenuse of about 0.26 inches. In one embodiment a pair of blades are placed about 0.28 inches apart, positioned equidistant from a central plane through a body 16, as shown. The edges of may be chisel or single bevel as shown in FIG. 5, with the bevels arranged mirror images of each other about the central plane, V shaped, concave, convex, or a combination thereof. The slicing edges 20 are preferably parallel to each other, as shown, and extend inward from opposite sides of an inner surface of the body 16.

The dimensions noted herein should accommodate most commercial hot dogs, but larger and/or smaller slicers are within the scope of this application to accommodate non-standard sizing. In other embodiments a hot dog slicer's 10 dimensions could be smaller or greater than the previously mentioned dimensions. Up to as much as about 1.5 times smaller or greater the previously mentioned dimensions.

Figure 6:
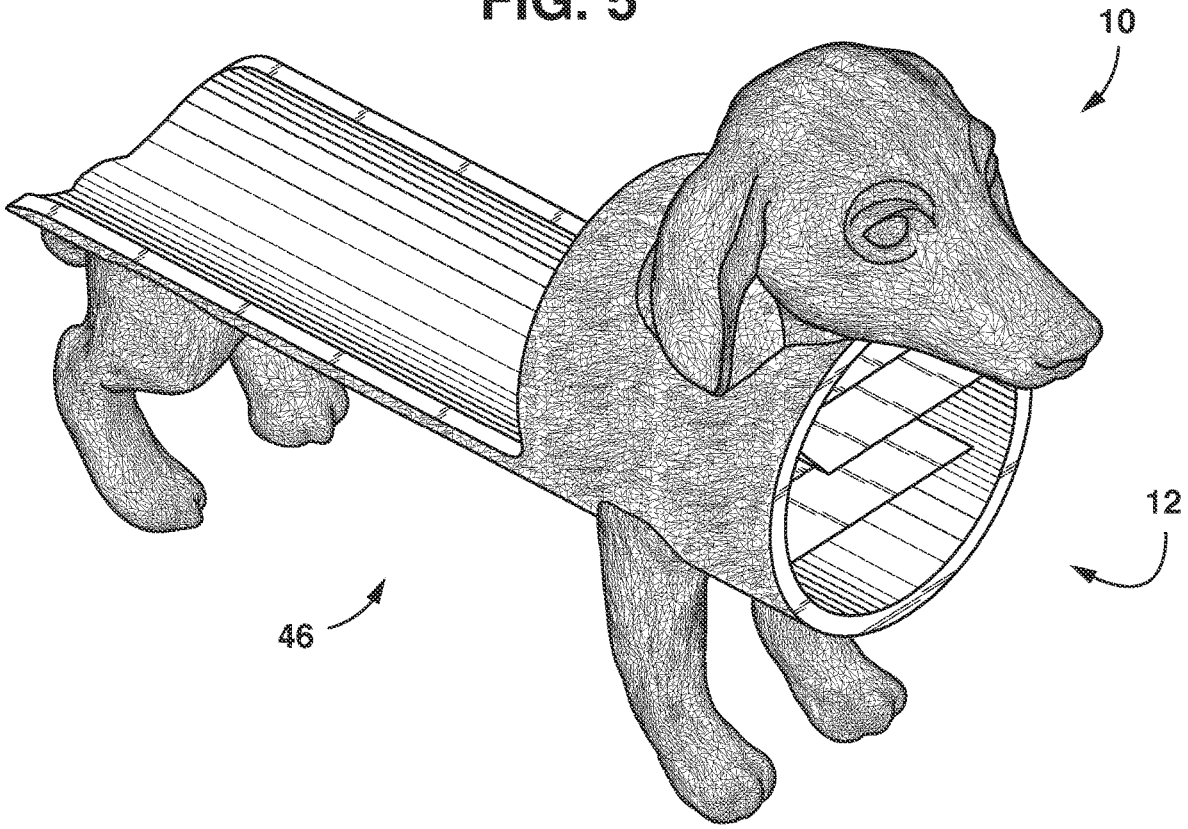
FIG. 6 is a perspective view of a hot dog slicer integrated into a novelty container.

FIG. 6 in particular is an example of a hot dog slicer 10 being manufactured within a novelty container 46, such as a dachshund dog, as an example. An infinite variety of other forms can serve as a novelty container 46, as well, for a hot dog slicer 10.

Figure 7:
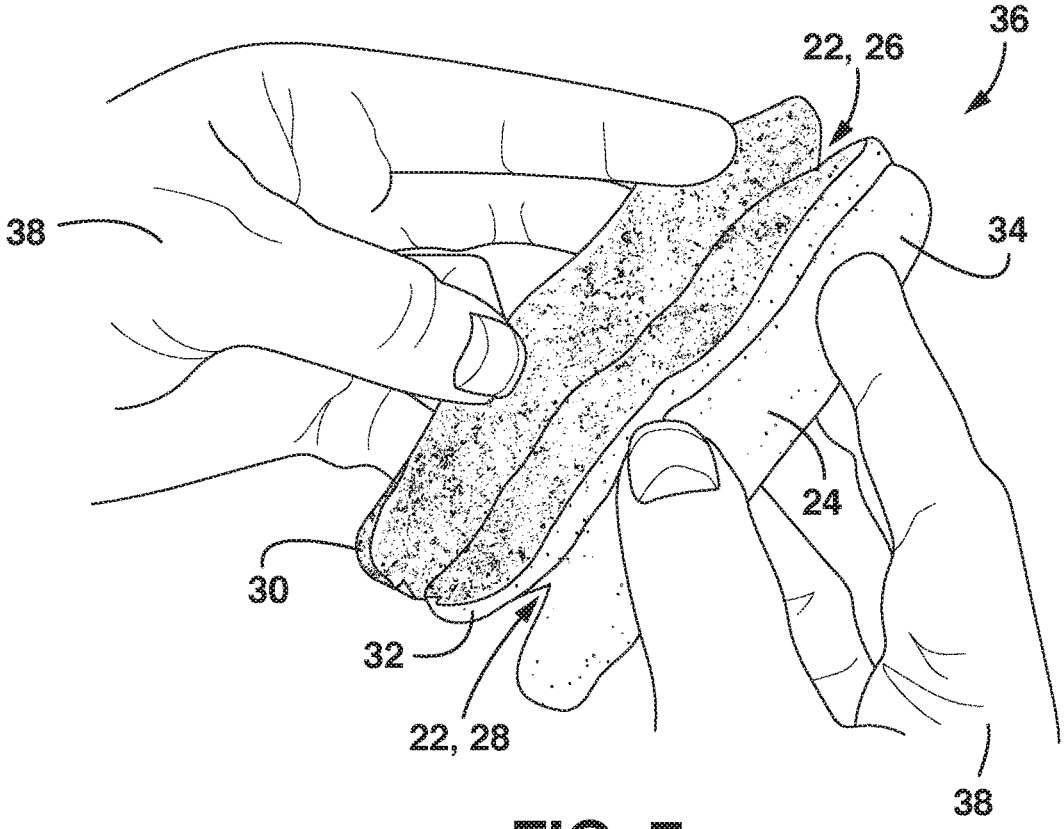
FIG. 7 is a perspective view of an open unfolded hot dog.

A hot dog slicer 10 used by a hot dog consumer 38 is used to produce a butterfly cut or slice a hot dog 24. A hot dog consumer places a hot dog 24 in front 12 of a hot dog slicer 10 aligning the hot dog 24 with the center of a body 16 and pushes the hot dog 24 into the blades 18, by use of hand, until the majority of the hot dog 24 has passed beyond the blades 18. Then consumer 38 reaches, with hand, to the back 14 of the body 16 and continues to pull the hot dog 24 completely through the blades 18 producing a butterfly cut or a sliced hot dog 24 capable of being pulled with two hands into an open unfolded hot dog 36 or butterfly cut. FIG. 7 is a perspective view of a hot dog 24 being transformed into an open unfolded hot dog 36 or butterfly cut.

The blades 18 of hot dog slicer 10 produce a right side cut 26 and a left side cut 28 in a hot dog 24. Thus, the hot dog 24 is divided into a top hot dog portion 30, a middle hot dog portion 32 and a bottom hot dog portion 34. The portions of the hot dog 24 are inter-linked together by a living hinge of hot dog 24 matter. The hot dog 24 can be fan unfolded to a Z end profile or further to a flat horizontal configuration, a butterfly cut and placed on a bun 44 with cheese slice 40 and condiment 42, as illustrated in FIG. 8. Butterflying also makes it possible to stack the open unfolded hot dogs 36 and use slices of cheese 40 inter-stacked on the open unfolded hot dogs 36.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A hot dog slicer comprising:

a tubular body having a lumen defined by an inner surface of said tubular body between front and rear opening therein, wherein said inner surface comprises a first portion opposite a second portion, and said lumen has a diameter of approximately 1.25 inches to approximately 1.5 inches;

a cutting mechanism comprising a first blade and a second blade, wherein said first blade extends inward from said first portion of said inner surface of said tubular body in cantilever fashion, and said second blade extends inward from said second portion of said inner surface of said tubular body in cantilever fashion, wherein said first blade and said second blade have parallel planer portions, are offset from each other, and partially overlap, wherein said first blade and said second blade extend inward between approximately 0.75 inches to approximately 0.97 inches each, and wherein said first blade is disposed approximately 0.15 inches below the cross-sectional center of said tubular body, and said second blade is disposed approximately 0.15 inches above the cross-sectional center of said tubular body.

2. The hot dog slicer of claim 1, wherein said tubular body has a cylindrical shape.

3. The hot dog slicer of claim 2, wherein said lumen has a diameter of approximately 1.25 inches to approximately 1.5 inches.

4. The hot dog slicer of claim 2, wherein said tubular body has a front to rear length of approximately 1.25 inches to approximately 1.5 inches.

5. The hot dog slicer of claim 1, wherein said blades have a maximum width of approximately 0.75 inches.

6. The hot dog slicer of claim 5, wherein the edges of said blades have a single bevel.

* * * * *